US005222052A

United States Patent [19]

Salame

[11] Patent Number: 5,222,052

[45] Date of Patent: Jun. 22, 1993

[54] TIME BREAKER

[75] Inventor: Camille G. Salame, Richland, Va.

[73] Assignee: Jocelyne C. Salame, Norwich, Conn.

[21] Appl. No.: 913,472

[22] Filed: Jul. 15, 1992

[51] Int. Cl.[5] ..... G04B 19/24; G09D 3/10; B42D 5/04

[52] U.S. Cl. ..... 368/28; 40/109; 283/2

[58] Field of Search ..... 368/28–40; 40/107, 109; 283/2–4; 235/85 R

[56] References Cited

U.S. PATENT DOCUMENTS

| | | | |
|---|---|---|---|
| 1,608,411 | 11/1926 | Mateju | 282/2 |
| 2,523,206 | 9/1950 | Fluette | 40/109 |
| 2,847,778 | 8/1958 | Opoczynski | 40/109 |
| 3,427,740 | 2/1969 | Heskes | 40/109 |
| 3,546,801 | 12/1970 | Kolody | 40/109 |
| 3,605,307 | 9/1971 | Dickson | 283/2 |
| 3,628,322 | 12/1971 | McDuffee et al. | 368/28 |
| 3,755,941 | 9/1973 | Leiske | 40/109 |
| 3,800,454 | 4/1974 | Anderson | 40/109 |
| 3,936,966 | 2/1976 | Zeiske | 40/109 |
| 4,253,169 | 2/1981 | Salah | 368/15 |
| 4,418,274 | 11/1983 | Masillo | 40/109 |
| 4,828,290 | 5/1989 | Harris | 283/2 |
| 4,972,393 | 11/1990 | Masahiro et al. | 368/28 |

OTHER PUBLICATIONS

"The Perpetucal", Columbian Art Works, Inc. 1990.

*Primary Examiner*—Vit W. Miska

[57] ABSTRACT

The day-name associated with any date under the Gregorian Calendar is determined by a process which first identifies, from tabulated data correlated to seven day-name categories, the day-name assigned to the first day of a centesimal year. Additional tabulated data correlates the day-name for the first day of a centesimal year to the day-name of the first day of any year within the century following the centesimal year. A third data set correlates the day-name for the first day of any particular year to the day-name for any particular month and number date within the year.

10 Claims, 6 Drawing Sheets

| | | | | | | | | | | | | | |
|---|---|---|---|---|---|---|---|---|---|---|---|---|---|
| | | | | | | | | | | | | | Su |
| | 1900 | | | 2300 | | | 2700 | | | 3100 | | | M |
| | | | | | | | | | | | | | T |
| 1800 | | | 2200 | | | 2600 | | | 3000 | | | 3400 | W |
| | | | | | | | | | | | | | Th |
| | | 2100 | | | 2500 | | | 2900 | | | 3300 | | F |
| | 2000 | | | 2400 | | | 2800 | | | 3200 | | | S |

FIG. 1

| | | | | | | | | | | | | | | | | | | |
|---|---|---|---|---|---|---|---|---|---|---|---|---|---|---|---|---|---|---|
| 00 | 06 | 12 | 17 | 23 | — | 34 | 40 | 45 | 51 | — | 62 | 68 | 73 | 79 | — | 90 | 96 | M |
| 01 | 07 | — | 18 | 24 | 29 | 35 | — | 46 | 52 | 57 | 63 | — | 74 | 80 | 85 | 91 | — | T |
| 02 | 08 | 13 | 19 | — | 30 | 36 | 41 | 47 | — | 58 | 64 | 69 | 75 | — | 86 | 92 | 97 | W |
| 03 | — | 14 | 20 | 25 | 31 | — | 42 | 48 | 53 | 59 | — | 70 | 76 | 81 | 87 | — | 98 | Th |
| 04 | 09 | 15 | — | 26 | 32 | 37 | 43 | — | 54 | 60 | 65 | 71 | — | 82 | 88 | 93 | 99 | F |
| — | 10 | 16 | 21 | 27 | — | 38 | 44 | 49 | 55 | — | 66 | 72 | 77 | 83 | — | 94 | | S |
| 05 | 11 | — | 22 | 28 | 33 | 39 | — | 50 | 56 | 61 | 67 | — | 78 | 84 | 89 | 95 | | Su |

FIG. 2

| | | | | | | | | | | | | | | | | |
|---|---|---|---|---|---|---|---|---|---|---|---|---|---|---|---|---|
| 00 | | O | | | | | O | | | — | | O | | | | | O |
| | | — | | O | | | — | | O | | | — | | O | | | — |
| | O | | | — | | O | | | — | | O | | | — | | O | |
| | — | | O | | | — | | O | | 59 | — | | O | | | — | |
| O | | | — | | O | | | — | | O | | | — | | O | | |
| — | | O | | | — | | O | | | — | | O | | | — | | |
| | | — | | O | | | — | | O | | | — | | O | | | |

| |
|---|
| W |
| Th |
| F |
| S |
| Su |
| M |
| T |

FIG. 28

| | | | | | | | | | | | | | | | | | | |
|---|---|---|---|---|---|---|---|---|---|---|---|---|---|---|---|---|---|---|
| 00 | 05 | 11 | — | 22 | 28 | 33 | 39 | — | 50 | 56 | 61 | 67 | — | 78 | 84 | 89 | 95 | M |
| — | 06 | 12 | 17 | 23 | — | 34 | 40 | 45 | 51 | — | 62 | 68 | 73 | 79 | — | 90 | 96 | T |
| 01 | 07 | — | 18 | 24 | 29 | 35 | — | 46 | 52 | 57 | 63 | — | 74 | 80 | 85 | 91 | — | W |
| 02 | 08 | 13 | 19 | — | 30 | 36 | 41 | 47 | — | 58 | 64 | 69 | 75 | — | 86 | 92 | 97 | Th |
| 03 | — | 14 | 20 | 25 | 31 | — | 42 | 48 | 53 | 59 | — | 70 | 76 | 81 | 87 | — | 98 | F |
| 04 | 09 | 15 | — | 26 | 32 | 37 | 43 | — | 54 | 60 | 65 | 71 | — | 82 | 88 | 93 | 99 | S |
| — | 10 | 16 | 21 | 27 | — | 38 | 44 | 49 | 55 | — | 66 | 72 | 77 | 83 | — | 94 | | Su |

JANUARY

| | | | | |
|---|---|---|---|---|
| 1 | 8 | 15 | 22 | 29 |
| 2 | 9 | 16 | 23 | 30 |
| 3 | 10 | 17 | 24 | 31 |
| 4 | 11 | 18 | 25 | |
| 5 | 12 | 19 | 26 | |
| 6 | 13 | 20 | 27 | |
| 7 | 14 | 21 | 28 | |

FIG. 4

FEBRUARY

| | | | | |
|---|---|---|---|---|
| | 5 | 12 | 19 | 26 |
| | 6 | 13 | 20 | 27 |
| | 7 | 14 | 21 | 28 |
| 1 | 8 | 15 | 22 | |
| 2 | 9 | 16 | 23 | |
| 3 | 10 | 17 | 24 | |
| 4 | 11 | 18 | 25 | |

FIG. 5

MARCH

| | | | | | |
|---|---|---|---|---|---|
| | 5 | 12 | 19 | 26 | |
| | 6 | 13 | 20 | 27 | |
| | 7 | 14 | 21 | 28 | |
| 1 | 8 | 15 | 22 | 29 | |
| 2 | 9 | 16 | 23 | 30 | |
| 3 | 10 | 17 | 24 | 31 | |
| 4 | 11 | 18 | 25 | | |

FIG. 6

APRIL

| | | | | | |
|---|---|---|---|---|---|
| | 2 | 9 | 16 | 23 | 30 |
| | 3 | 10 | 17 | 24 | |
| | 4 | 11 | 18 | 25 | |
| | 5 | 12 | 19 | 26 | |
| | 6 | 13 | 20 | 27 | |
| | 7 | 14 | 21 | 28 | |
| 1 | 8 | 15 | 22 | 29 | |

FIG. 7

MAY

| | | | | |
|---|---|---|---|---|
| | 7 | 14 | 21 | 28 |
| 1 | 8 | 15 | 22 | 29 |
| 2 | 9 | 16 | 23 | 30 |
| 3 | 10 | 17 | 24 | 31 |
| 4 | 11 | 18 | 25 | |
| 5 | 12 | 19 | 26 | |
| 6 | 13 | 20 | 27 | |

FIG. 8

JUNE

| | | | | |
|---|---|---|---|---|
| | 4 | 11 | 18 | 25 |
| | 5 | 12 | 19 | 26 |
| | 6 | 13 | 20 | 27 |
| | 7 | 14 | 21 | 28 |
| 1 | 8 | 15 | 22 | 29 |
| 2 | 9 | 16 | 23 | 30 |
| 3 | 10 | 17 | 24 | |

FIG. 9

JULY

| | | | | | |
|---|---|---|---|---|---|
| | 2 | 9 | 16 | 23 | 30 |
| | 3 | 10 | 17 | 24 | 31 |
| | 4 | 11 | 18 | 25 | |
| | 5 | 12 | 19 | 26 | |
| | 6 | 13 | 20 | 27 | |
| | 7 | 14 | 21 | 28 | |
| 1 | 8 | 15 | 22 | 29 | |

FIG. 10

AUGUST

| | | | | | |
|---|---|---|---|---|---|
| | 6 | 13 | 20 | 27 | |
| | 7 | 14 | 21 | 28 | |
| 1 | 8 | 15 | 22 | 29 | |
| 2 | 9 | 16 | 23 | 30 | |
| 3 | 10 | 17 | 24 | 31 | |
| 4 | 11 | 18 | 25 | | |
| 5 | 12 | 19 | 26 | | |

FIG. 11

SEPTEMBER

| | | | | | |
|---|---|---|---|---|---|
| | 3 | 10 | 17 | 24 | |
| | 4 | 11 | 18 | 25 | |
| | 5 | 12 | 19 | 26 | |
| | 6 | 13 | 20 | 27 | |
| | 7 | 14 | 21 | 28 | |
| 1 | 8 | 15 | 22 | 29 | |
| 2 | 9 | 16 | 23 | 30 | |

FIG. 12

OCTOBER

| | | | | | |
|---|---|---|---|---|---|
| 1 | 8 | 15 | 22 | 29 | |
| 2 | 9 | 16 | 23 | 30 | |
| 3 | 10 | 17 | 24 | 31 | |
| 4 | 11 | 18 | 25 | | |
| 5 | 12 | 19 | 26 | | |
| 6 | 13 | 20 | 27 | | |
| 7 | 14 | 21 | 28 | | |

FIG. 13

NOVEMBER

| | | | | | |
|---|---|---|---|---|---|
| | 5 | 12 | 19 | 26 | |
| | 6 | 13 | 20 | 27 | |
| | 7 | 14 | 21 | 28 | |
| 1 | 8 | 15 | 22 | 29 | |
| 2 | 9 | 16 | 23 | 30 | |
| 3 | 10 | 17 | 24 | | |
| 4 | 11 | 18 | 25 | | |

FIG. 14

DECEMBER

| | | | | | |
|---|---|---|---|---|---|
| | 3 | 10 | 17 | 24 | 31 |
| | 4 | 11 | 18 | 25 | |
| | 5 | 12 | 19 | 26 | |
| | 6 | 13 | 20 | 27 | |
| | 7 | 14 | 21 | 28 | |
| 1 | 8 | 15 | 22 | 29 | |
| 2 | 9 | 16 | 23 | 30 | |

FIG. 15

L. JANUARY

| | | | | |
|---|---|---|---|---|
| 1 | 8 | 15 | 22 | 29 |
| 2 | 9 | 16 | 23 | 30 |
| 3 | 10 | 17 | 24 | 31 |
| 4 | 11 | 18 | 25 | |
| 5 | 12 | 19 | 26 | |
| 6 | 13 | 20 | 27 | |
| 7 | 14 | 21 | 28 | |

FIG. 16

L. FEBRUARY

| | | | | |
|---|---|---|---|---|
| | 5 | 12 | 19 | 26 |
| | 6 | 13 | 20 | 27 |
| | 7 | 14 | 21 | 28 |
| 1 | 8 | 15 | 22 | 29 |
| 2 | 9 | 16 | 23 | |
| 3 | 10 | 17 | 24 | |
| 4 | 11 | 18 | 25 | |

FIG. 17

L. MARCH

| | | | | | |
|---|---|---|---|---|---|
| | 4 | 11 | 18 | 25 | |
| | 5 | 12 | 19 | 26 | |
| | 6 | 13 | 20 | 27 | |
| | 7 | 14 | 21 | 28 | |
| 1 | 8 | 15 | 22 | 29 | |
| 2 | 9 | 16 | 23 | 30 | |
| 3 | 10 | 17 | 24 | 31 | |

FIG. 18

L. APRIL

| | | | | | |
|---|---|---|---|---|---|
| 1 | 8 | 15 | 22 | 29 | |
| 2 | 9 | 16 | 23 | 30 | |
| 3 | 10 | 17 | 24 | | |
| 4 | 11 | 18 | 25 | | |
| 5 | 12 | 19 | 26 | | |
| 6 | 13 | 20 | 27 | | |
| 7 | 14 | 21 | 28 | | |

FIG. 19

L. MAY

| | | | | |
|---|---|---|---|---|
| | 6 | 13 | 20 | 27 |
| | 7 | 14 | 21 | 28 |
| 1 | 8 | 15 | 22 | 29 |
| 2 | 9 | 16 | 23 | 30 |
| 3 | 10 | 17 | 24 | 31 |
| 4 | 11 | 18 | 25 | |
| 5 | 12 | 19 | 26 | |

FIG. 20

L. JUNE

| | | | | |
|---|---|---|---|---|
| | 3 | 10 | 17 | 24 |
| | 4 | 11 | 18 | 25 |
| | 5 | 12 | 19 | 26 |
| | 6 | 13 | 20 | 27 |
| | 7 | 14 | 21 | 28 |
| 1 | 8 | 15 | 22 | 29 |
| 2 | 9 | 16 | 23 | 30 |

FIG. 21

L. JULY

| | | | | | |
|---|---|---|---|---|---|
| 1 | 8 | 15 | 22 | 29 | |
| 2 | 9 | 16 | 23 | 30 | |
| 3 | 10 | 17 | 24 | 31 | |
| 4 | 11 | 18 | 25 | | |
| 5 | 12 | 19 | 26 | | |
| 6 | 13 | 20 | 27 | | |
| 7 | 14 | 21 | 28 | | |

FIG. 22

L. AUGUST

| | | | | | |
|---|---|---|---|---|---|
| | 5 | 12 | 19 | 26 | |
| | 6 | 13 | 20 | 27 | |
| | 7 | 14 | 21 | 28 | |
| 1 | 8 | 15 | 22 | 29 | |
| 2 | 9 | 16 | 23 | 30 | |
| 3 | 10 | 17 | 24 | 31 | |
| 4 | 11 | 18 | 25 | | |

FIG. 23

L. SEPTEMBER

| | | | | | |
|---|---|---|---|---|---|
| | 2 | 9 | 16 | 23 | 30 |
| | 3 | 10 | 17 | 24 | |
| | 4 | 11 | 18 | 25 | |
| | 5 | 12 | 19 | 26 | |
| | 6 | 13 | 20 | 27 | |
| | 7 | 14 | 21 | 28 | |
| 1 | 8 | 15 | 22 | 29 | |

FIG. 24

L. OCTOBER

| | | | | | |
|---|---|---|---|---|---|
| | 7 | 14 | 21 | 28 | |
| 1 | 8 | 15 | 22 | 29 | |
| 2 | 9 | 16 | 23 | 30 | |
| 3 | 10 | 17 | 24 | 31 | |
| 4 | 11 | 18 | 25 | | |
| 5 | 12 | 19 | 26 | | |
| 6 | 13 | 20 | 27 | | |

FIG. 25

FIG. 26

L. NOVEMBER

| | | | | | |
|---|---|---|---|---|---|
| | 4 | 11 | 18 | 25 | |
| | 5 | 12 | 19 | 26 | |
| | 6 | 13 | 20 | 27 | |
| | 7 | 14 | 21 | 28 | |
| 1 | 8 | 15 | 22 | 29 | |
| 2 | 9 | 16 | 23 | 30 | |
| 3 | 10 | 17 | 24 | | |

FIG. 27

L. DECEMBER

| | | | | | |
|---|---|---|---|---|---|
| | 2 | 9 | 16 | 23 | 30 |
| | 3 | 10 | 17 | 24 | |
| | 4 | 11 | 18 | 25 | |
| | 5 | 12 | 19 | 26 | |
| | 6 | 13 | 20 | 27 | |
| | 7 | 14 | 21 | 28 | |
| 1 | 8 | 15 | 22 | 29 | |

TIME BREAKER

BACKGROUND OF THE INVENTION

1. Field of the Invention

The present invention relates to a method and apparatus for correlating the named day of the week to a past or future date as specified by the year, month and numerical day of the month.

2. Description of the Prior Art

The occidental method of measuring a solar year with 365 days punctuated every fourth year by 366 days was decreed in 45 B.C. by Julius Caesar. Although this Julian Calendar was a vast improvement over prior methods of solar year measurement, it nevertheless was in error by about eleven minutes per year. By the year 1582, the Julian Calendar was proceeding with a 10 day error.

In the year 1582, Pope Gregory XIII decreed that the day following Oct. 4, 1582 would become Oct. 15, 1582. Moreover, those centesimal years (ending in 00) not evenly divisible by 400 would not be leap years, i.e., the respective February would have only 28 days. In operation, therefore, the centesimal year of 1600 had a 29 day February. The subsequent centesimal years of 1700, 1800 and 1900 had only 28 day Februaries. However, the forthcoming centesimal year of 2000 will again have a 29 day February.

This Gregorian modification of the Julian Calendar perpetrates an error of less than one day per 3000 years. No further correction is anticipated before the year 4600.

In the interim, cultural evolution has attached great significance to the seven day division of the 52 solar weeks. Although watershed dates of history are usually recorded in terms of the year, month and date, there are occasions when the day-name of the week the event occurred is as important as the year, month and day number.

Serious historians and long term event planners have need for a convenient and reliable method and or apparatus for assigning the correct week day name to a particular numbered day of the month in any year, past and future.

Prior art for such need has been represented by a system that correlates one of fourteen annual calendars to each year from 1700 to 2108 only. There is no orderly procedure to extrapolate from this date delineated interval.

SUMMARY OF THE INVENTION

The day-name associated with any date under the Gregorian Calendar is determined by a process which first identifies, from a table, first sheet supported data the day-name assigned to the first day of a centesimal year and whether that centesimal year is a leap year or non-leap year (year number ending in 00). Knowing the day-name of the first day in a centesimal year, and whether that centesimal year is a leap year or non-leap year the first day of any year within the corresponding century is determined from a second sheet supported data table.

Twenty-four month/day-number matrices are provided on sheet supported tables respective to the twelve months in an interim year and the twelve months in a leap year. From the appropriate month/day-number matrix and the known day-name for January 1 of that year, the desired day-name is determined.

BRIEF DESCRIPTION OF THE DRAWINGS

Relative to the several figures of the drawings, like reference characters designate like or similar elements throughout the several figures:

FIG. 1 is a matrix table on a tabulated data support sheet which correlates the day-name for January 1 respective to each centesimal year from 1800 to 3400.

FIG. 2 is a matrix table on a tabulated data support sheet which is correlated with the FIG. 1 matrix to determine the day-name for January 1 respective to each year within the century following a non-leap centesimal year.

FIGS. 4–15 are numerical date tables on a tabulated data support sheet respective to each month in a non-leap year.

FIGS. 16–27 are numerical date tables on a tabulated data support sheet respective to each month in a leap year.

FIG. 28 is a setting example of the FIG. 2 table; and

DESCRIPTION OF THE PREFERRED EMBODIMENT

Figures 3, 29:
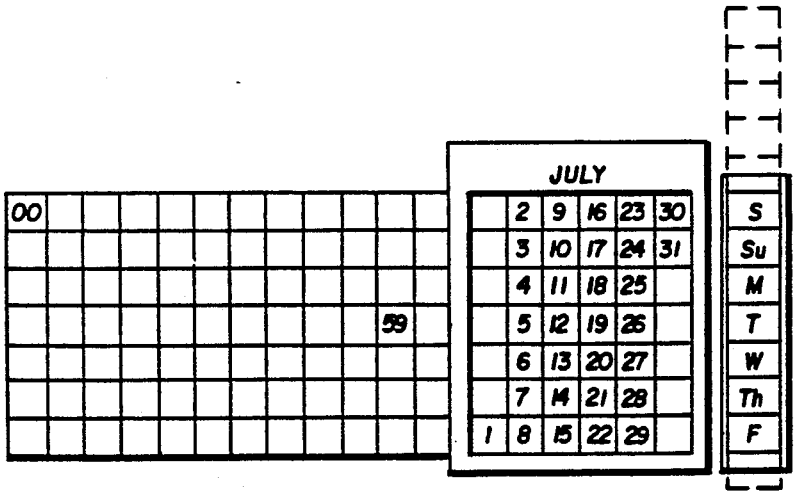
FIG. 3 is a matrix table on a tabulated data support sheet which is correlated with the FIG. 1 matrix to determine the day-name for January 1 respective to each year within the century following a centesimal leap year.
FIG. 29 is a setting example of the FIG. 2 and FIG. 10 tables to identify the day-name of a particular numerical date.

By traditional definition, a "century" is delineated as the 100 years transpiring between January 1 of an '01 year and December 31 of the centesimal year ('00) following, Hence, the twentieth century began on Tuesday, January 1, 1901, and will end on Sunday, December 31, 2000. The twenty first century begins on Monday, January 1, 2001. Although this definition of a "century" is well established by ancient usage, reliance upon such definition unnecessarily complicates an orderly, day-name/month-number coordinate system. Consequently, for the purposes of this invention and the corresponding process, a "century" will herein be specially defined as that 100 year interval between January 1 of a centesimal year and December 31 of the following '99 year.

The FIG. 1 illustrates a suitable sheet for supporting tabulated data such as paper having a matrix table comprising 13 vertically extended columns and seven horizontal rows. There may be additional columns respective to expanded coverage in either direction, past or future. The number of horizontal rows, however, is fixed at seven by the number of named days in a calendar week. Communicated by FIG. 1 are the basic correlations between a centesimal year, one that ends in 00, and the day-name for January 1 respective to those years.

Certain observations may be made of the FIG. 1 informational order. First, no centesimal years begin on Sunday, Tuesday or Thursday. Second, the centesimal leap years, designated by distinctive indicia such as a circle around the respective year numbers in the FIG. 1 matrix, begin only on Saturdays. Resultantly, the centesimal non-leap years begin only on Monday, Wednesday or Friday and progress inversely, e.g., the year 2100 begins on Friday, the year 2200 begins on Wednesday and the year 2300 begins on Monday. It is also useful to observe that the Gregorian calendar system cycles evenly over 400 year periods.

In further operation, the non-leap year information of FIG. 1 is related to the informational matrix of FIG. 2 whereas the leap year information of FIG. 1 is specifically related to the FIG. 3 matrix.

The information matrix of FIG. 2 distributes all years of a century following a centesimal non-leap year within seven horizontal day-name rows and eighteen vertical columns. The centesimal year 00 is assigned the reference position in the top row, first column from the left. From this reference position, the years advance down a column top to bottom and from column to column left to right. The leap years within a century are circled. After each leap year, a row is passed and the year count resumed on the second row following a leap year.

Laterally of FIG. 2 is an adjustably positioned day-name strip of data supporting sheet material having the day-names for two weeks advancing successively from top to bottom. These day-names are vertically spaced to align with the seven horizontal rows of the FIG. 1 year matrix.

FIG. 3 is substantially the same as FIG. 2 except for the fact that the centesimal reference year is a leap year. Consequently, the day-name row following the centesimal leap year is passed and the year count resumed with 01 on the third day-name row down from the top. From that point, the order of progression continues as was explained for FIG. 2.

The numerical date tables respective to each month of a year are divided into two set groupings. The FIGS. 4–15 set is prepared for non-leap years whereas the FIGS. 16–27 set is prepared for leap years. Both sets are matrix configured with seven horizontal rows vertically spaced to align with the seven horizontal rows of the FIG. 2 and FIG. 3 matrices. Day number progression advances down a vertical column and left to right from column to column.

Aside from the fact that a leap year February has 29 days and a non-leap year February has only 28, the two numerical date table sets are distinct. However, the January configuration is common to both sets.

Except for February, all months of the year have the same number of assigned days respective to both leap and non-leap years, i.e., the month of March has 31 days in both leap and non-leap years. However, the two numerical date table sets differ by the matrix positionment of the first day for the months of March through December.

Specifically, for a non-leap year, day one is located in the first column, first horizontal row matrix cell for the months of January and October; first column, second row matrix cell for the month of May; first column, third row matrix cell for the month of August; first column, fourth row matrix cell for the months of February, March and November; first column, fifth row matrix cell for the month of June; first column, sixth row matrix cell for the months of September and December; and first column, seventh row matrix cell for the months of April and July.

In a leap year, day one is located in the first horizontal row for the months of January, April and July; in the second row for the month of October; in the third row for the month of May; in the fourth row for the months of February and August; in the fifth row for the months of March and November; in the sixth row for the month of June; and, in the seventh row for the months of September and December.

Finding the day-name corresponding to a specific numbered date, month and year by the aforedescribed tabulated data is a process that is best taught by a series of examples.

Example I: Find the day-name for Jul. 4, 1859.

Step 1: From FIG. 1, the centesimal year 1800 matrix block is located in the fourth row of the table which reveals the first day of that centesimal year as having been a Wednesday.

Step 2: Regarding FIG. 2, the day-name strip on the right side of FIG. 2 is laterally confined by slits in the support sheet so that the strip threads through a first, slit from the support sheet backface, across the support sheet front face, and through a second slit back to the support sheet backface. Through the slits, the strip is vertically adjusted to align the Wednesday strip space with the first, centesimal year (00), table row. See FIG. 28.

Step 3: The body of FIG. 2 is scanned to find the row including the 59th year of the century. This is the fourth row down from the top. The day-name strip space at the right side of FIG. 2 aligned within the 59th year row is noted to be Saturday, i.e., Jan. 1, 1859 occurred on Saturday. See FIG. 28.

Step 4: The FIG. 2 day-name strip is adjusted again to locate the Saturday strip space in the first, centesimal year row. See FIG. 29.

Step 5: The numerical data support sheet having the date table of FIG. 10 respective to a non-leap year July is laid over the FIG. 2 table with the first, horizontal, row of the July matrix aligned with the first, centesimal row of FIG. 2 and the Saturday strip space. See FIG. 29.

Step 6: Scanning the July matrix, the 4th day of July is located in the 3rd horizontal row of the July matrix. This 3rd horizontal row of the July matrix is read to have been Monday. See FIG. 30.

Answer: Jul. 4, 1859 fell on Monday.

Example II: Find the day-name corresponding to Jul. 4, 1776.

Step 1: From FIG. 1, the first day of the centesimal year 1700 is determined to have fallen on Friday. Although the year 1700 is not displayed on the FIG. 1 table, the correct conclusion is easily extrapolated from the data that is displayed.

Step 2: Regarding FIG. 2, the day-name strip on the right side of FIG. 2 is vertically adjusted to align the Friday strip space with the first, centesimal year (00), horizontal row.

Step 3: The body of FIG. 2 is scanned to find the row including the 76th year of the century. The day-name strip space aligned within the 76th year row is noted to be Monday, i.e., Jan. 1, 1776 was on Monday.

Step 4: Also noted from the body of FIG. 2 and the fact that the 76 number is circled, the 76th year of the century is recognized as a leap year.

Step 5: The FIG. 2 day-name strip is adjusted again to position the Monday strip space in the first centesimal year row.

Step 6: The data support sheet having the numerical date table of FIG. 22 respective to a leap year July (L. July is laid over the FIG. 2 table with the first, horizontal, row of the L. July matrix aligned with the first, centesimal row of the FIG. 2 table whereby Monday aligns with the first or top row of the L. July matrix.

Step 7: The L. July matrix is scanned for the 4th day which is found to be positioned in the fourth row of the matrix. This fourth row of the L. July matrix aligns with Thursday on the day-name strip.

Answer: Jul. 4, 1776 fell on Thursday.

Example III: Find the day-name corresponding to Jul. 4, 1992.

Step 1: From FIG. 1, the first day of the centesimal year 1900 is determined to have fallen on Monday. It is also noted that because 1900 is not evenly divisible by 400, the centesimal year 1900 is not a leap year.

Step 2: The day-name strip on the right side of FIG. 2 is adjusted to align the Monday strip space with the first, centesimal year (00), horizontal row.

Step 3: Scanning the body of FIG. 2, the 92nd year of the century is found in the third horizontal row down from the top and in alignment with Wednesday on the day-name strip. Translated, Jan. 1, 1992 fell on Wednesday.

Step 4: Noted from the circle around the number 92 on FIG. 2, the year is recognized as a leap year.

Step 5: The FIG. 2 day-name strip is adjusted again to position the Wednesday strip space in the first centesimal year row.

Step 6: The data support sheet having the numerical date table of FIG. 22 respective to a leap year July (L. July) is laid over the FIG. 2 table with the first, horizontal, row of the L. July matrix aligned with the first, centesimal row of the FIG. 2 table whereby Wednesday aligns with the first or top row of the L. July matrix.

Step 7: The L. July matrix is scanned for the 4th day which is found to be positioned in the fourth row of the matrix. This fourth row of the L. July matrix aligns with Saturday on the day-name strip.

Answer: Jul. 4, 1992 falls on Saturday.

Example IV: Find the day-name corresponding to Jul. 4, 2000.

Step 1: The year 2000 is evenly divisible by 400. Consequently, year 2000 will be a centesimal leap year. As revealed by FIG. 1, January 1 of centesimal leap years occurs only on Saturday.

Step 2: Knowing the name of the first day of the centesimal leap year 2000, the sliding day-name strip of FIG. 3 is adjusted to align the Saturday space on the strip with the first or centesimal year row of FIG. 3.

Step 3: The data support sheet having the numerical date table of FIG. 22 respective to a leap year July (L. July) is laid upon the FIG. 3 table with the first, horizontal, row of the L. July matrix aligned with the first, centesimal row of the FIG. 3 table whereby Saturday aligns with the first or top row of the L. July matrix.

Step 4: The L. July matrix is scanned for the 4th day which is found to be positioned in the fourth row of the matrix. This fourth row of the L. July matrix aligns with Tuesday on the day-name strip.

Answer: Jul. 4, 2000 falls on Tuesday.

It will be understood by those of skill in the art that the illustrated data tables are merely devices for data organization and manipulation. Obviously, such tables and devices may be programmed for electric or electronic data processing. Moreover, the entire process may be programmed for automatic data processing equipment.

Specifically, the description of tables as having columns and rows is merely a literary device for organizing cyclical data. Numerical data is assigned corresponding cellular addresses which repeat or cascade on seven unit cycles.

It should also be noted that although the invention is extremely accurate, some discrepancies may arise regarding day-name correspondence to past numerical dates in particular jurisdictions. Such discrepancies relate to the jurisdictional adoption of the Gregorian Calendar. Most Roman Catholic nations adopted the calendar in 1582. The British Empire did not adopt the calendar until Sep. 2, 1752, a Wednesday, which was followed by Thursday, Sep. 14, 1752. In correct order, Sep. 2, 1752 should have been a Saturday. Japan made the change in 1873, China in 1912, Greece in 1924 and Turkey in 1927.

Having fully disclosed my invention, those of ordinary skill in the art will perceive obvious modification and adaptations. As my invention, however,

I claim:

1. A combination of tables for correlating Gregorian Calendar numbered days to weekly name-days, past, present and future, comprising:

a first tabulated data matrix supported by first sheet means for correlating the day-name respective to the January 1 of centesimal years between 1500 and 4600 and for differentiating between centesimal leap years that are evenly divisible by 400 and all other, non-leap centesimal years;

a second tabulated data matrix supported by second sheet means having seven, uniformly wide, adjacently spaced and parallel rows proceeding top to bottom, said rows being divided along their lengths into eighteen adjacently parallel columns proceeding left to right and perpendicular to said rows, bounded areas delineated by intersections of said rows and columns providing data address positions, that address position common to the top row and first column from left being the reference address for a non-leap centesimal year and chronologically successive years in a century assigned to correspondingly successive address positions in an order proceeding top to bottom and left to right except for the first year following a leap year which is assigned to the second successive address position following the preceeding leap year address position, said leap years being differentiated from non-leap years as matrix data;

third sheet means supporting an independently adjustable column divided into a multiplicity of address areas, each of a height corresponding to the uniform width and parallel spacing of said second matrix rows, said adjustable column address areas supporting a repetitive week sequence of day-name indicia;

alignment means structurally secured with said second sheet means to laterally confine said third sheet means adjacent said second data matrix as an additional column therewith that may be longitudinally adjusted to align a particular day-name with a desired second data matrix row whereby the adjustable column day-name respective to January 1 of a particular year is aligned in the second data matrix row corresponding to said particular year when the adjustable column day-name respective to January 1 of the non-leap centesimal year of said particular year century is aligned in the top row of said second data matrix.

2. A combination as described by claim 2 wherein the first day of the non-leap year months of January and October are positioned at the reference address, the first day of the non-leap year month of May is positioned one address position removed from the reference address, the first day of the non-leap year month of August is positioned two address positions removed from the reference address, the first day of the non-leap year months of February, March and November are positioned three address positions removed from the reference address, the first day of the non-leap year month of June is positioned four address positions removed from the reference address the first day of the non-leap year months of September and December are positioned five address positions removed from the reference address and the first day of the non-leap year months of April and July are positioned six address positions removed from the reference address.

3. A combination as described by claim 2 wherein the first day of the leap year months of January, April and July are positioned at the reference address, the first day of the leap year month of October is positioned one address position removed from the reference address, the first day of the leap year month of May is positioned two address positions removed from the reference address, the first day of the leap year months of February and August are positioned three address positions removed from the reference address, the first day of the leap year months of March and November are positioned four address positions removed from the reference address, the first day of the leap year month of June is positioned five address positions removed from the reference address and the first day of the leap year months of September and December is positioned six address positions removed from the reference address.

4. A combination of tables for correlating Gregorian Calendar numbered days to weekly name-days, past, present and future, comprising:

a first tabulated data matrix supported by first sheet means for correlating the day-name respective to the January 1 of centesimal years between 1500 and 4600 and for differentiating between centesimal leap years that are evenly divisible by 400 and all other, non-leap centesimal years;

a second tabulated data matrix supported by second sheet means having seven, uniformly wide, adjacently spaced and parallel rows proceeding top to bottom, said rows being divided along their lengths into eighteen adjacently parallel columns proceeding left to right and perpendicular to said rows, bounded areas delineated by intersections of said rows and columns providing data address positions, that address position common to the top row and first column from left being the reference address for a centesimal leap year and chronologically successive years in a century assigned to correspondingly successive address positions in an order proceeding top to bottom and left to right except for the first year following a leap year which is assigned to the second successive address position following the preceeding leap year address position, said leap years being differentiated from non-leap years as matrix data;

third sheet means supporting an independently adjustable column divided into a multiplicity of address areas, each of a height corresponding to the uniform width and parallel spacing of said second matrix rows, said adjustable column address areas supporting a repetitive week sequence of day-name indicia;

alignment means structurally secured with said second sheet means to laterally confine said third sheet means adjacent said second data matrix as an additional column therewith that may be longitudinally adjusted to align a particular day-name with a desired second data matrix row whereby the adjustable column day-name respective to January 1 of an objective year is aligned in the second data matrix row corresponding to said objective year when the adjustable column day-name respective to January 1 of the centesimal leap year of said objective year century is aligned in the top row of said second data matrix.

5. A combination of tables as described by claim 4 comprising additional sheet means respective to twelve data matrices corresponding to the twelve months of a leap year, said month matrix data being arranged in seven parallel rows having matching alignment with said second data matrix rows and sufficient columns respective to the number of days of a particular month, areas delineated by intersections of said rows and columns providing day number address positions with the top row, first column from left address position being a reference address position and the first day of each month in a leap year having a distinctive address displacement from said reference position whereby alignment of a particular month matrix with said third sheet means positions the day-name corresponding to the first day of said particular month in the respective month matrix row when the day-name for January 1 of the objective year is aligned in the top row.

6. A combination of tables as described by claim 4 comprising additional sheet means respective to twelve data matrices corresponding to the twelve months of a non-leap year, said month matrix data being arranged in seven parallel rows having matching alignment with said second data matrix rows and sufficient columns respective to the number of days of a particular month, areas delineated by intersections of said rows and columns providing day number address positions with the top row, first column from left address position being a reference address position and the first day of each month in a non-leap year having a distinctive address displacement from said reference position whereby alignment of a particular month matrix with said third sheet means positions the day-name corresponding to the first day of said particular month in the respective month matrix row when the day-name for January 1 of the objective year is aligned in the top row.

7. A combination of tables as described by claim 1 comprising additional sheet means respective to twelve data matrices corresponding to the twelve months of a leap year, said month matrix data being arranged in seven parallel rows having matching alignment with said second data matrix rows and sufficient columns respective to the number of days of a particular month, areas delineated by intersections of said rows and columns providing day number address positions with the top row, first column from left address position being a reference address position and the first day of each month in a leap year having a distinctive address displacement from said reference position whereby alignment of a particular month matrix with said third sheet means positions the day-name corresponding to the first day of said particular month in the respective month matrix row when the day-name for January 1 of the objective year is aligned in the top row.

8. A combination as described by claim 7 wherein the first day of the leap year months of January, April and July are positioned at the reference address, the first day of the leap year month of October is positioned one address position removed from the reference address, the first day of the leap year month of May is positioned two address positions removed from the reference address, the first day of the leap year months of February and August are positioned three address positions removed from the reference address, the first day of the leap year months of March and November are positioned four address positions removed from the reference address, the first day of the leap year month of June is positioned five address positions removed from the reference address and the first day of the leap year months of September and December is positioned six address positions removed from the reference address.

9. A combination of tables as described by claim 1 comprising additional sheet means respective to twelve data matrices corresponding to the twelve months of a non-leap year, said month matrix data being arranged in seven parallel rows having matching alignment with said second data matrix rows and sufficient columns respective to the number of days of a particular month, areas delineated by intersections of said rows and columns providing day number address positions with the top row, first column from the left address position being a reference address position and the first day of each month in a non-leap year having a distinctive address displacement from said reference position whereby alignment of a particular month matrix with said third sheet means positions the day-name corresponding to the first day of said particular month in the respective month matrix row when the day-name for January 1 of the objective year is aligned in the top row.

10. A combination as described by claim 9 wherein the first day of the non-leap year months of January and October are positioned at the reference address, the first day of the non-leap year month of May is positioned one address position removed from the reference address, the first day of the non-leap year month of August is positioned two address positions removed from the reference address, the first day of the non-leap year months of February, March and November are positioned three address positions removed from the reference address, the first day of the non-leap year month of June is positioned four address positions removed from the reference address and the first day of the non-leap year months of April and July are positioned six address positions removed from the reference address.

* * * * *